US010697597B2

(12) United States Patent
Salm

(10) Patent No.: US 10,697,597 B2
(45) Date of Patent: Jun. 30, 2020

(54) HOUSING, CONNECTOR AND SYSTEM

(71) Applicant: GLP German Light Products GmbH, Karlsbad (DE)

(72) Inventor: Markus Salm, Heusweiler (DE)

(73) Assignee: GLP German Light Products GmbH, Karlsbad (DE)

( * ) Notice: Subject to any disclaimer, the term of this patent is extended or adjusted under 35 U.S.C. 154(b) by 471 days.

(21) Appl. No.: 15/390,104

(22) Filed: Dec. 23, 2016

(65) Prior Publication Data

US 2017/0191625 A1 Jul. 6, 2017

(30) Foreign Application Priority Data

Dec. 23, 2015 (DE) ..... 10 2015 226 704

(51) Int. Cl.

| | |
|---|---|
| ***F21V 21/26*** | (2006.01) |
| ***F21S 2/00*** | (2016.01) |
| ***F21V 21/088*** | (2006.01) |
| ***F21V 15/01*** | (2006.01) |
| *F21Y 115/10* | (2016.01) |

(52) U.S. Cl.

CPC ..... *F21S 2/005* (2013.01); *F21V 15/01* (2013.01); *F21V 21/088* (2013.01); *F21V 21/26* (2013.01); *F21Y 2115/10* (2016.08)

(58) Field of Classification Search

CPC ..... F21S 2/005; F21V 21/088; F21V 21/26; F21V 15/01; F21Y 2115/10

See application file for complete search history.

(56) References Cited

U.S. PATENT DOCUMENTS

| | | | | |
|---|---|---|---|---|
| 4,447,859 A * | 5/1984 | Raczynski | G03B 15/05 362/11 |
| 5,453,917 A * | 9/1995 | Ogawa | E04G 1/06 362/152 |
| 5,510,966 A * | 4/1996 | Konecny | F21S 8/028 362/145 |
| 6,213,626 B1 * | 4/2001 | Qian | F16M 11/10 248/125.8 |
| 2007/0171635 A1 | 7/2007 | Liao et al. | |

(Continued)

FOREIGN PATENT DOCUMENTS

| | | |
|---|---|---|
| CN | 104089206 A | 10/2014 |
| CN | 204664885 U | 9/2015 |

(Continued)

*Primary Examiner* — Anh T Mai
*Assistant Examiner* — Fatima N Farokhrooz
(74) *Attorney, Agent, or Firm* — Michael A. Glenn; Perkins Coie LLP

(57) ABSTRACT

A housing of a lighting apparatus comprises at least two first engagement portions on different sides of the housing. The first engagement portions are suitable for being connected to second engagement portions of a connector by translatory pushing into each other such that the housing is restricted relative to the connector in two degrees of freedom in a translatory respect and in three degrees of freedom in a rotary respect. The first engagement portion comprises means for latching suitable for allowing engagement of the means for latching of the second engagement portion in the first engagement portion so that the housing is restricted relative to the connector in a third degree of freedom in a translatory respect.

13 Claims, 19 Drawing Sheets

(56) References Cited

U.S. PATENT DOCUMENTS

| | | | | |
|---|---|---|---|---|
| 2010/0157602 | A1* | 6/2010 | Nichols | F21V 19/02<br>362/277 |
| 2013/0155688 | A1* | 6/2013 | LaVigna | F21V 21/00<br>362/311.01 |

FOREIGN PATENT DOCUMENTS

| | | | |
|---|---|---|---|
| DE | 3217122 | A1 | 11/1983 |
| DE | 20312420 | U1 | 12/2003 |
| DE | 202006010053 | U1 | 8/2006 |

* cited by examiner

HOUSING, CONNECTOR AND SYSTEM

CROSS-REFERENCE TO RELATED APPLICATIONS

This application claims priority from German Patent Application No. 10 2015 226 704.0, filed Dec. 23, 2015, which is incorporated herein by reference in its entirety.

BACKGROUND OF THE INVENTION

Embodiments of the present invention relate to a housing for a lighting apparatus, to a connector for the housing, and to a system. Further embodiments relate to a system comprising a plurality of lighting apparatuses which are connected to one another by means of connectors to form a matrix.

Typically, lighting apparatuses comprise a housing which may be mounted to a cross-beam or another mounting point by means of a bracket. Further lighting apparatuses may also be integrated in a housing such that the housing accommodates several lighting apparatuses. Such a unit may also be referred to as spot unit, wherein said spot unit may typically also be mounted using a kind of bracket.

Starting here, the illuminator chooses either one or several individual lighting apparatuses or a lighting unit for the respective lighting situation, depending on how much lighting is required. If the lighting unit provides for too much lighting and the individual lighting apparatus allows only too little lighting, several lighting apparatuses may be arranged next to one another in order to scale the lighting. However, these lighting apparatuses have to be oriented individually to the area to be illuminated, thereby increasing the complexity for installation. Therefore, there is demand for an improved approach.

SUMMARY

In accordance with an embodiment, a housing of a lighting apparatus may have: at least two first engagement portions at two different sides of the housing; wherein each first engagement portion is suitable for being connectable to a second engagement portion of a connector by translatory pushing into each other such that the housing is restricted relative to the connector in two degrees of freedom in a translatory respect and in three degrees of freedom in a rotary respect; wherein the at least two first engagement portions are each formed by a plate spaced apart from the housing and/or a slot nut; wherein the first engagement portion has means for latching suitable for allowing engagement of the means for latching of the second engagement portion in the first engagement portion so that the housing is restricted relative to the connector in a third degree of freedom in a translatory respect; wherein the means for latching of the first engagement portion have a spring element which is movable transverse to the third degree of freedom; and wherein the means for latching of the second engagement portion have a recess transverse to the third degree of freedom, in which the spring element may engage; or wherein the means for latching of the second engagement portion have a spring element which is movable transverse to the third degree of freedom; and wherein the means for latching of the first engagement portion have a recess transverse to the third degree of freedom, in which the spring element may engage; wherein the means for latching may be released from outside.

In accordance with another embodiment, a connector for connecting a housing of a lighting apparatus may have: at least one second engagement portion for the housing; and a further engagement portion for an element coupled to the housing; wherein first engagement portions of the housing are each formed by a plate spaced apart from the housing and/or a slot nut; wherein every second engagement portion is connectable to a first engagement portion of the housing by translatory pushing into each other such that the housing is restricted relative to the connector in two degrees of freedom in a translatory respect and in three degrees of freedom in a rotary respect; wherein the first engagement portion has means for latching suitable for allowing engagement of the means for latching of the second engagement portion in the first engagement portion so that the housing is restricted relative to the connector in a third degree of freedom in a translatory respect; wherein the means for latching of the first engagement portion have a spring element which is movable transverse to the third degree of freedom; and wherein the means for latching of the second engagement portion have a recess transverse to the third degree of freedom, in which the spring element may engage; or wherein the means for latching of the second engagement portion have a spring element which is movable transverse to the third degree of freedom; and wherein the means for latching of the first engagement portion have a recess transverse to the third degree of freedom, in which the spring element may engage; wherein the means for latching may be released from outside.

In accordance with another embodiment, a system may have: a housing a mentioned above; and a connector for connecting a housing of a lighting apparatus, having: at least one second engagement portion for the housing; and a further engagement portion for an element coupled to the housing; wherein first engagement portions of the housing are each formed by a plate spaced apart from the housing and/or a slot nut; wherein every second engagement portion is connectable to a first engagement portion of the housing by translatory pushing into each other such that the housing is restricted relative to the connector in two degrees of freedom in a translatory respect and in three degrees of freedom in a rotary respect; wherein the first engagement portion has means for latching suitable for allowing engagement of the means for latching of the second engagement portion in the first engagement portion so that the housing is restricted relative to the connector in a third degree of freedom in a translatory respect; wherein the means for latching of the first engagement portion have a spring element which is movable transverse to the third degree of freedom; and wherein the means for latching of the second engagement portion have a recess transverse to the third degree of freedom, in which the spring element may engage; or wherein the means for latching of the second engagement portion have a spring element which is movable transverse to the third degree of freedom; and wherein the means for latching of the first engagement portion have a recess transverse to the third degree of freedom, in which the spring element may engage; wherein the means for latching may be released from outside.

In accordance with another embodiment, a system may have: a housing as mentioned above; two connectors for connecting a housing of a lighting apparatus, having: at least one second engagement portion for the housing; and a further engagement portion for an element coupled to the housing; wherein first engagement portions of the housing are each formed by a plate spaced apart from the housing and/or a slot nut; wherein every second engagement portion is connectable to a first engagement portion of the housing by translatory pushing into each other such that the housing is restricted relative to the connector in two degrees of freedom in a translatory respect and in three degrees of freedom in a rotary respect; wherein the first engagement portion has means for latching suitable for allowing engagement of the means for latching of the second engagement portion in the first engagement portion so that the housing is restricted relative to the connector in a third degree of freedom in a translatory respect; wherein the means for latching of the first engagement portion have a spring element which is movable transverse to the third degree of freedom; and wherein the means for latching of the second engagement portion have a recess transverse to the third degree of freedom, in which the spring element may engage; or wherein the means for latching of the second engagement portion have a spring element which is movable transverse to the third degree of freedom; and wherein the means for latching of the first engagement portion have a recess transverse to the third degree of freedom, in which the spring element may engage; wherein the means for latching may be released from outside; wherein the element coupled to the housing is a two-sided bracket, and wherein the further engagement portion is implemented as a retainer for the housing for connecting to a two-sided bracket, wherein the two-sided bracket is connected to an additional further engagement portion of an additional connector which engages in the other first engagement portion on the opposite side of the housing; and a two-sided bracket.

In accordance with still another embodiment, a system may have: at least two housings as mentioned above; and at least one connector for connecting a housing of a lighting apparatus, having: at least one second engagement portion for the housing; and a further engagement portion for an element coupled to the housing; wherein first engagement portions of the housing are each formed by a plate spaced apart from the housing and/or a slot nut; wherein every second engagement portion is connectable to a first engagement portion of the housing by translatory pushing into each other such that the housing is restricted relative to the connector in two degrees of freedom in a translatory respect and in three degrees of freedom in a rotary respect; wherein the first engagement portion has means for latching suitable for allowing engagement of the means for latching of the second engagement portion in the first engagement portion so that the housing is restricted relative to the connector in a third degree of freedom in a translatory respect; wherein the means for latching of the first engagement portion have a spring element which is movable transverse to the third degree of freedom; and wherein the means for latching of the second engagement portion have a recess transverse to the third degree of freedom, in which the spring element may engage; or wherein the means for latching of the second engagement portion have a spring element which is movable transverse to the third degree of freedom; and wherein the means for latching of the first engagement portion have a recess transverse to the third degree of freedom, in which the spring element may engage; wherein the means for latching may be released from outside, wherein the element coupled to the housing is a further housing, and wherein the further engagement portion is a second engagement portion and is configured for engaging a first engagement portion of a further housing.

Embodiments of the present invention provide a housing of a lighting apparatus, comprising at least two first engagement portions at two different sides of the housing. Each first engagement portion may be connected to a second engagement portion of a connector by means of translatory pushing into one another such that the housing is restricted relative to the connector in two degrees of freedom in a translatory respect and in three degrees of freedom in a rotatory respect. The first engagement portion comprises means for latching suitable for allowing engagement of means for latching of the second engagement portion in the first engagement portion so that the housing is restricted relative to the connector in a third degree of freedom in a translatory respect.

The central idea of the present invention is having recognized that a freely scalable concept is provided by a first flange (first engagement portion) at the housing in combination with a second flange (second engagement portion) of a connector, the second flange forming the counterpart to the first flange, by the connector comprising a further engagement portion or further flange for either a retainer or for a further housing. Thus, it is advantageously possibly to form a freely scalable lighting unit (lighting matrix) from individual lighting apparatuses with their respective housings, or to mount the lighting apparatus alone or as a unit using the respective connectors. By selecting shapes which can be pushed into one another, like dove tail connections or generally connections based on undercutting, for the flange, the work of orienting the individual lighting apparatuses may be omitted since the orientation of the lighting apparatuses among one another is fixed already by the geometry of the connector. Such connectors which allow a parallel orientation of the lighting apparatuses or an angled orientation, like an orientation angled by 45°, are possible direct connectors.

In correspondence with further embodiments, the first engagement portion extends as a first rail along a longitudinal axis such that the rail comprises a first profile which also extends along the longitudinal axis. The second engagement portion which, as has been described above, forms the counterpart, also extends along the longitudinal axis as a second rail. The second rail comprises a second profile extending along the longitudinal axis. In order to form the counterpart and at the same time allow mounting, either the first or the second profile comprises an undercutting into which the other profile may be pushed along the longitudinal axis. Such a connection provides a simple, but mechanically stable mechanism which restricts the five degrees of freedom mentioned before of the two elements to be connected (lighting and connector).

In correspondence with embodiments, these engagement portions of the housing are arranged at two opposite sides of the housing so that one connector may be coupled to each side and these two connectors are additionally connected to a two-sided retaining bracket in order to mount the lighting apparatus to a further element, like a cross-beam. Optionally, the two-sided retaining bracket may be implemented as a so-called double bracket which serves as a foot when folded out and, when folded in, as a conventional bracket by means of which the lighting apparatus may, for example, be mounted to a cross-beam. This means that further embodiments provide a connector comprising at least one second engagement portion for the housing and a further engagement portion for a retainer for the housing. As an alternative to two-sided retaining, a simple clamp may be provided as a retainer so that the lighting apparatus may also be mounted only on one side relative to the further element/cross-beam.

Thus, embodiments provide a system comprising at least one housing, as discussed above, and a connector for coupling a retainer. Furthermore, the system may also comprise the corresponding retainer. Depending on whether the retainer is a one-sided or a two-sided retainer, the system comprises the clamp in combination with a bracket, or double bracket. In the case of the bracket or double bracket, the system typically comprises two equal connectors.

In accordance with further embodiments, the connector may also comprise a second engagement portion instead of or as a further engagement portion so that the connector connects two housings of lighting apparatuses to each other. In accordance with embodiments, it is of advantage here for the lighting apparatus to comprise two or, advantageously, four first engagement portions at four different sides (that is arranged at 90° relative to one another, for example), since in this way the lighting apparatuses may be arranged to form a matrix or, generally, a two-dimensional arrangement using the connectors. Further embodiments provide a system comprising at least two of the housings discussed before and an interconnector. This system may be extended by further embodiments by connectors for coupling a retainer so that the lighting unit provided by means of the interconnectors may be mounted to an external element, for example a cross-beam.

Embodiments provide a system comprising at least three, but advantageously more than three housings of a lighting apparatus which are connected to one another by at least two, but preferably more interconnectors so as to form a flat lighting matrix. This means that a two-dimensional flat and freely scalable lighting element is provided.

Another embodiment relates to the interconnector which comprises C-shaped openings, for example, so that it can couple the two housings which comprise the counterpart, that is the slot nut or the plate having the undercut.

BRIEF DESCRIPTION OF THE DRAWINGS

Embodiments of the present invention will be detailed subsequently referring to the appended drawings, in which:

FIG. 1*b*-1 and FIG. 1*b*-2 shows six schematic lateral views of the embodiment of FIG. 1*a*-1, FIG. 1*a*-2 and FIG. 1*a*-3 for illustrating the range of movement of the housing relative to the retainer;

FIG. 3*a*-1, FIG. 3*a*-2, FIG. 3*b*-1, and FIG. 3*b*-2 each show four schematic lateral views when pushing the connector into the engagement portion of the lighting apparatus housing, with respective enlarged illustrations, wherein in this embodiment the connector is an interconnector;

FIG. 4*a*-1, FIG. 4*a*-2, FIG. 4*b*-1, and FIG. 4*b*-2 show schematic illustrations of lighting apparatuses positioned in a matrix arrangement which are connected to one another by means of interconnectors in accordance with embodiments.

DETAILED DESCRIPTION OF THE INVENTION

Figures 1, 1A:
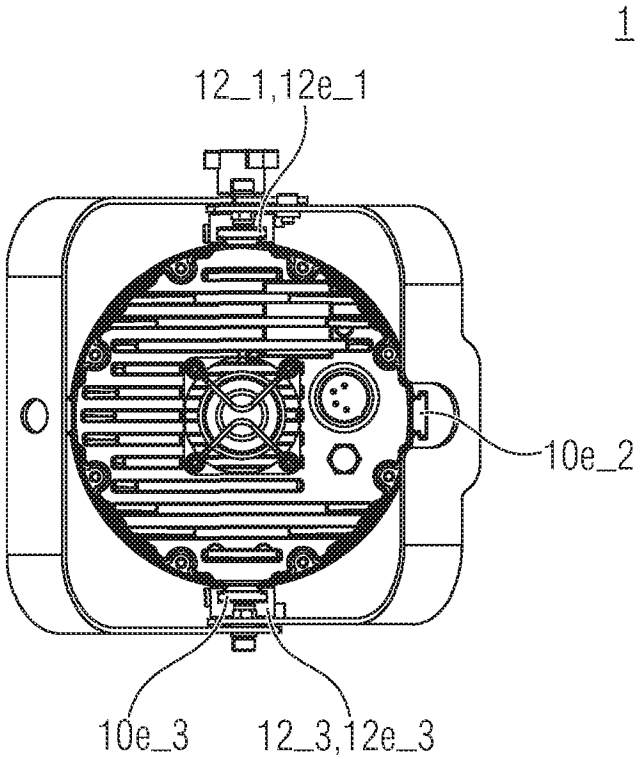
FIG. 1*a*-1, FIG. 1*a*-2 and FIG. 1*a*-3 shows five schematic lateral views of a lighting apparatus housing in combination with two connectors and at least one bracket as a retainer, wherein in this embodiment the retainer is implemented as a foot.

Before discussing embodiments of the present invention below in greater detail referring to the enclosed drawings, it is pointed out that equal elements and structures or those of equal effect are provided with equal reference numerals so that the description thereof is mutually applicable or interchangeable.

FIG. 1*a*-1, FIG. 1*a*-2 and FIG. 1*a*-3 shows a lighting apparatus 1 comprising a housing 10*g*, wherein the housing 10 is arranged to be cuboid and comprises a lighting opening 10*o* on one side. This lighting opening 10*o* is arranged on the front part of the housing 10*g*, wherein the mounting receptacles are provided on the back part of the housing 10*g*.

In this embodiment, the mounting receptacles are implemented as at least two engagement portions 10*e*. Since the round or cuboid lighting apparatus 1 comprises four basically perpendicular side faces, in this embodiment—instead of at least two—four optional engagement portions 10*e* are provided which are provided with the reference numerals 10*e*_1, 10*e*_2, 10*e*_3 and 10*e*_4. The engagement portions 10*e*_1 to 10*e*_4 are exemplarily based on the undercutting principle. This allows fitting the coupled connectors 12_1 and 12_3 into each other by means of pushing along a longitudinal axis 10*l* of the housing 10. These inserted connections are of advantage in that plugging is considerably less complicated for a fitter compared to conventional screwing.

The realization (used here) of dove tail guides of the engagement portions 10*e*_l to 10*e*_4 is particularly clear in the front view and back view of the spotlight housing 10. The engagement portion 10*e*_2 comprises such a profile that the foot of the profile, that is that part facing the housing 10*g*, is narrower than the head of the engagement portion. The connector (cf. connector 12*e*_3) also comprises a profile as a second engagement portion 12*e*_3 which, after pushing in, surrounds the profile of the engagement portion 10*e*_3. The result is that the degree of freedom may be restricted by such a connection in two longitudinal directions (that is in all except for the direction 10*l*), and in all rotary directions.

In other words, this means that the engagement portion 10*e*_1 and 10*e*_3 comprises a plate which is spaced apart from the actual housing 10 so that the second engagement portion 12*e*_1 and 12*e*_2 which exemplarily comprises a C profile engage below said plate when pushed in and thus forms the connection—while restricting the degrees of freedom in two translatory directions and in the three rotary directions. Different types of these connections will be discussed referring to FIGS. 5*a* to 5*c*.

In the embodiment illustrated here or, generally, in correspondence with extended embodiments, the connectors 12_1 and 12_3 are each provided at two opposite sides of the housing 10*g*. The connectors 12_1 and 12_3 comprise, as has been discussed already, a second engagement portion 12*e*_3 and 12*e*_1, respectively, on the one side, whereas a further engagement portion 12*w*_1 and 12*w*_3, respectively, is provided on a second side. Due to the fact that the two interconnectors 12_3 and 12_1 are inserted or arranged at opposite sides of the housing 10, the further engagement portions 12*w*_3 and 12*w*_l are each directed in mutually opposite directions. An optional bracket 14 which is mounted to be pivotable relative to the connectors 12_3, 12_1 is then mounted via these further engagement portions 12*w*_3 and 12*w*_1. This bracket 14 comprises two 90° angles so that it clutches the lighting apparatus 10. This bracket 14 allows the lighting apparatus 1 to be pivotable relative to the bracket 14 and, thus, also relative to a support of fixed location. A knurled screw 14*r* screwed into one of interconnectors 12_1 and guided within a slot 14*n* of the bracket may be provided for locking the pivot mechanism.

It is to be pointed out here that the knurled screw 14*r* or, generally, the locking mechanism may also be implemented in different ways.

Figures 1, 1A, 2:
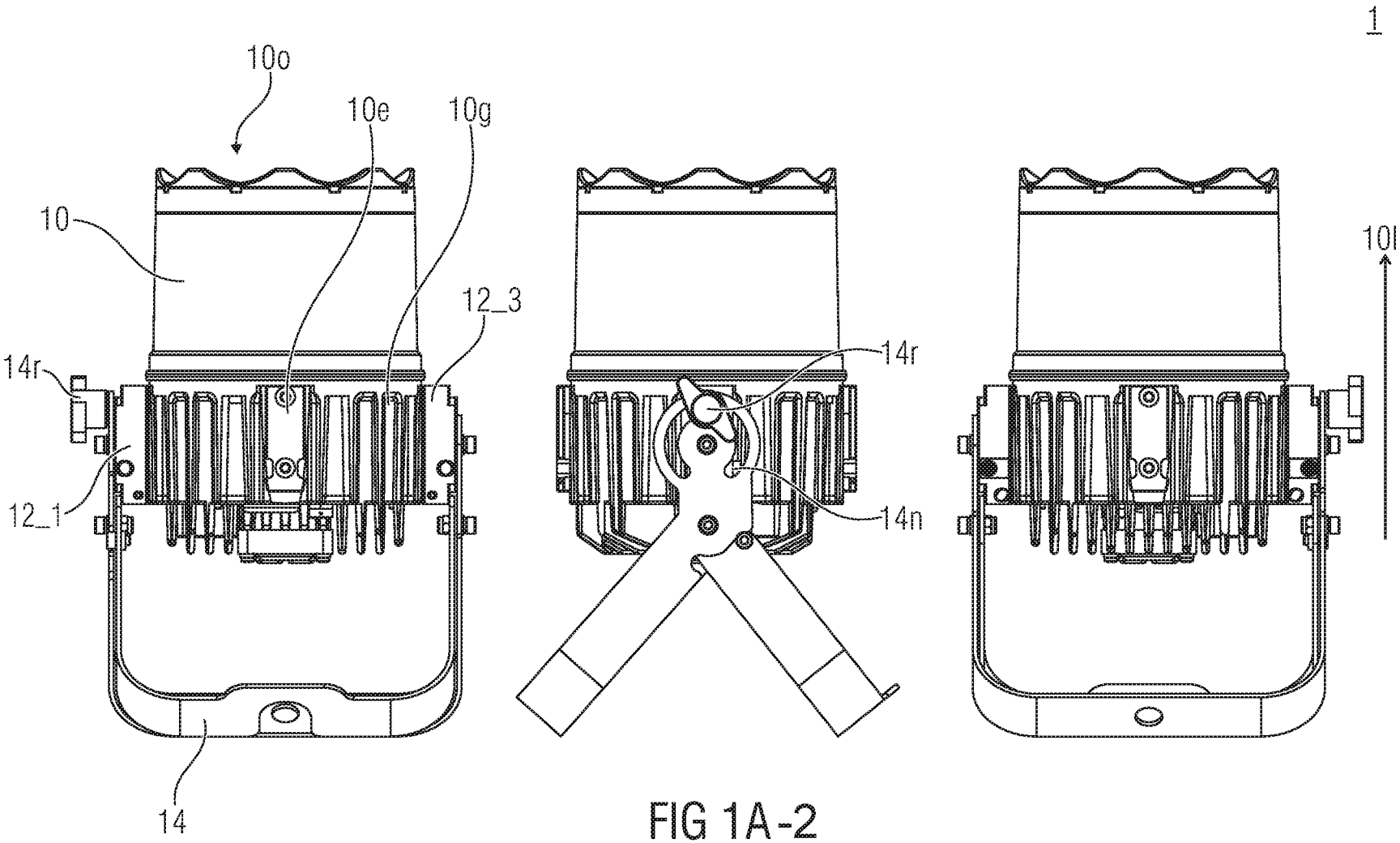
Figures 1, 1A, 2, 3:
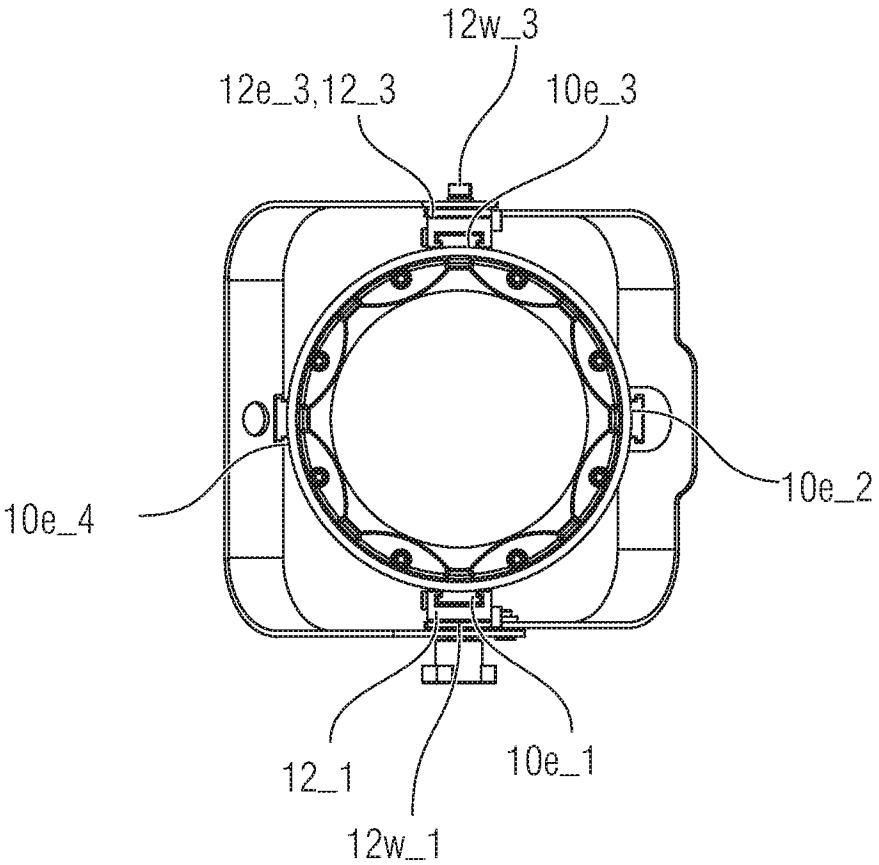
Figures 1, 1B:
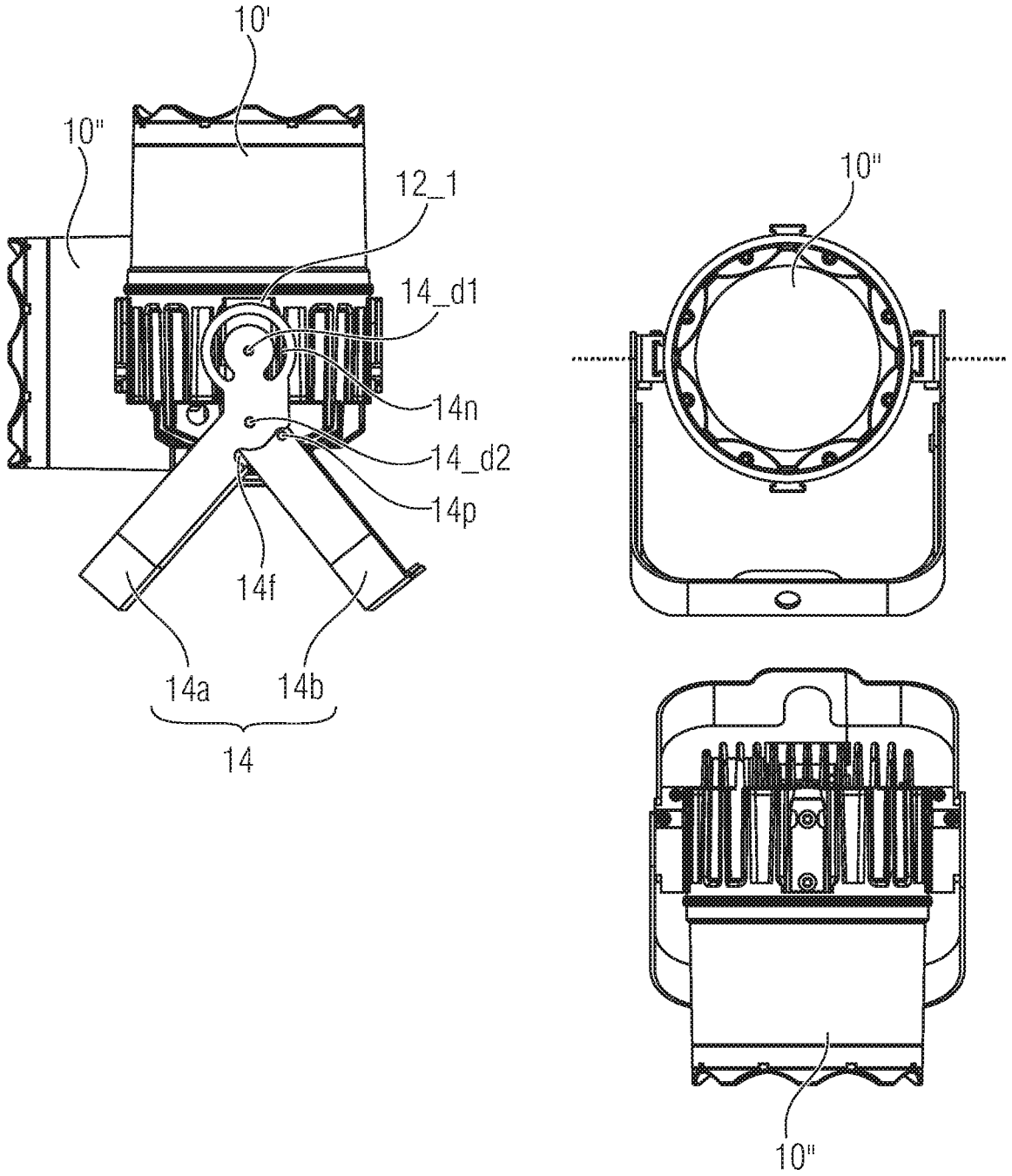
Figures 1, 1B, 2:
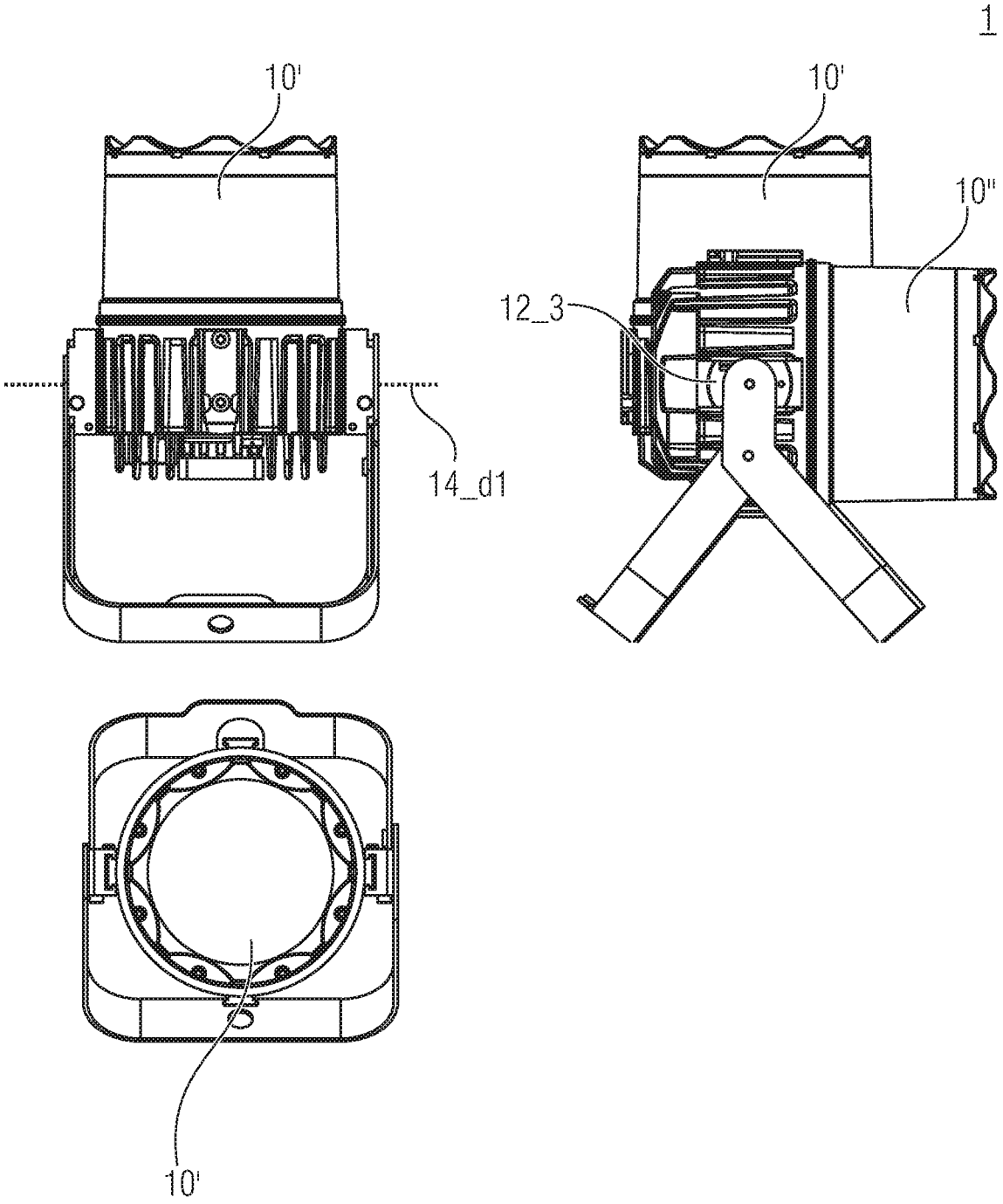

The range of movement of the spotlight 1 relative to the bracket 14 is illustrated in FIG. 1*b*-1 and FIG. 1*b*-2, wherein it is assumed that the bracket 14 is not screwed to a cross-beam, but serves as a foot. In FIG. 1*b*-1 and FIG. 1*b*-2, two lighting apparatuses oriented in different directions are illustrated, wherein a housing directed upwards is provided with the reference numeral 10', whereas a housing directed laterally has the reference numeral 10". As can be recognized and, particularly, as limited by the slot 14*n*, all in all, the lighting apparatus housing 10' and 10" may be rotated by 270° or more around the point or axis of rotation 14_*d*1.

By comparing the two lateral views, it becomes clear that, due to the slot 14*n*, the bracket 14 on the side of the interconnector 12_1 is implemented to be different than on the side of the interconnector 12_3.

In correspondence with embodiments, the bracket, as is also illustrated in FIGS. 1*a* and 1*b*, may also be implemented as a so-called double bracket. This double bracket comprises the two elements 14*a* and 14*b* (each brackets) which are movable relative to each other around the point of rotation 14*d*2. Optionally, a first and a second relative position between the brackets 14*a* and 14*b* may be implemented by the guide 14*f* and the bolt 14*b*. In the first relative positions, the two brackets 14*a* and 14*b* are angled relative to each other, for example, arranged to be at an angle of 90°, and thus form a foot. In the second relative position, the two brackets 14*a* and 14*b* (cf. FIG. 2A, FIG. 2B and FIG. 2C) are folded in and thus parallel, which allows the bracket 14 to be usable as a conventional retaining bracket.

Figures 1, 3A:
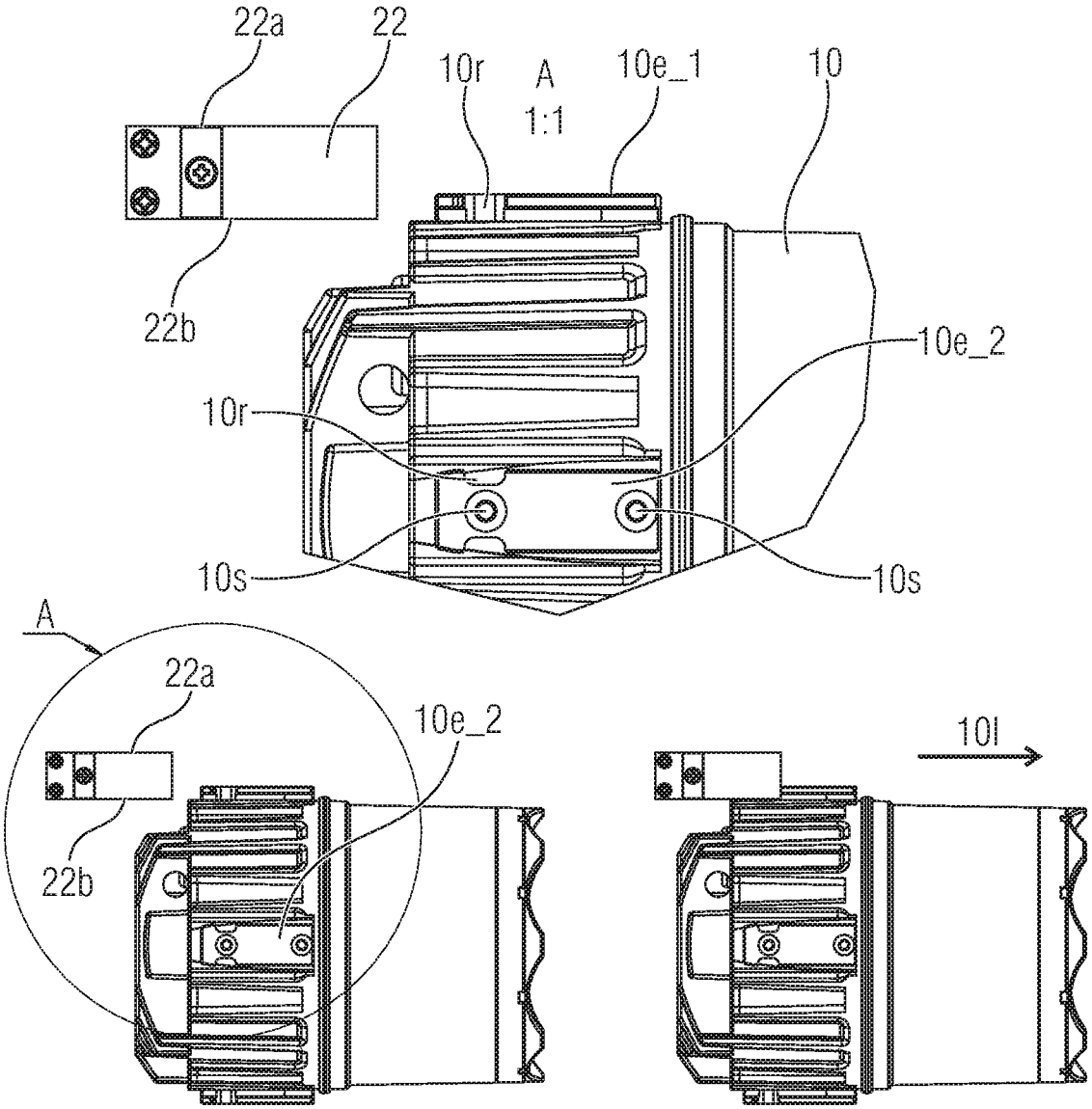
Figures 2, 3A:
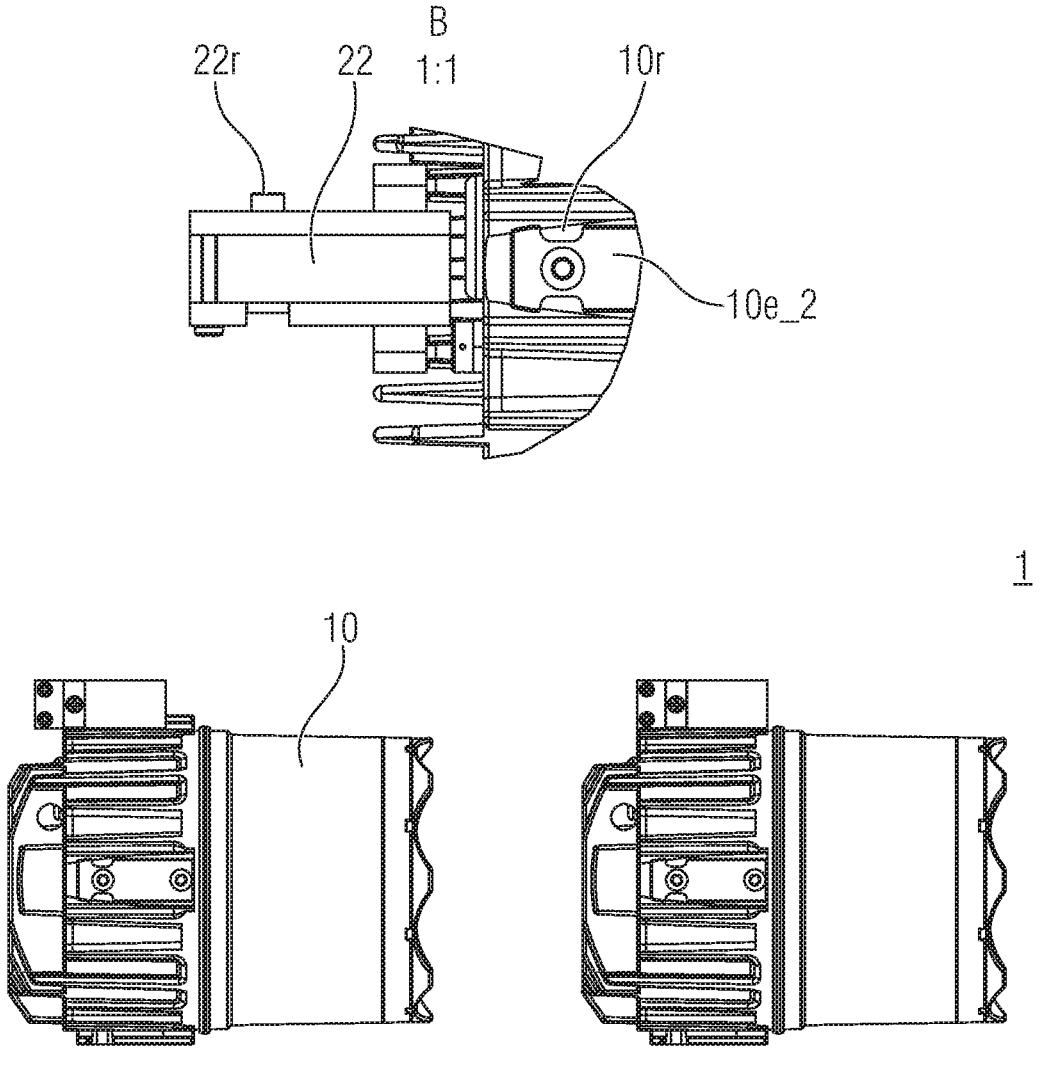
Figures 1, 3B:
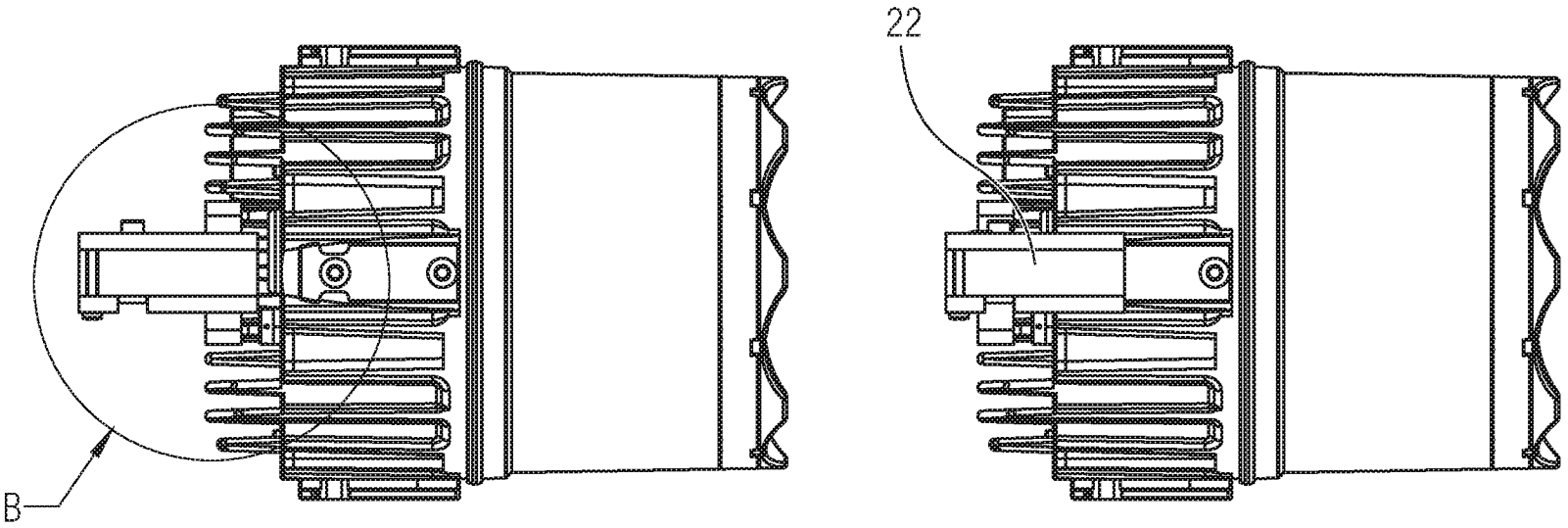
Figures 2, 3B:
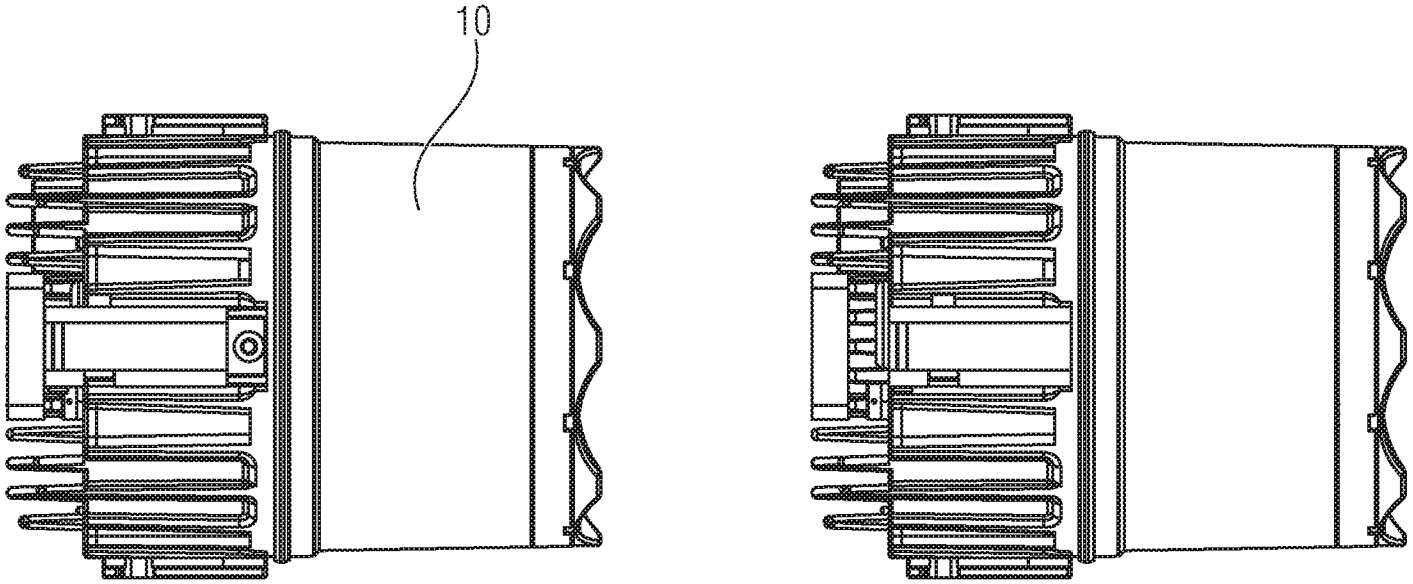

These connecters illustrated may, as is discussed referring to FIG. 3*a*-1, FIG. 3*a*-2, FIG. 3*bi*1, and FIG. 3*b*-2, also be equipped with means for latching 10*r* and 22*r* or latching means so that forces along the third longitudinal axis Z/10*l* (cf. FIGS. 3*a*, 3*b*) may be supported. Generally, it is to be stated that features having been discussed in connection with the connector 22, may also be applied to the connector 12, and vice versa. These comprise a spring element 22*r* (bolt or ball) which is movable transverse to the third degree of freedom Z on the side of the second engagement portion 12*e*_1 and 12*e*_2 10*e*_1, wherein the means for latching the first engagement portion 10*e*_2, 10*e*_3 and 10*e*_4 comprise a recess 10*r* transverse to the third degree of freedom Z which the spring element may engage in.

Alternatively, the means for latching the first engagement portion 10*e*_1, 10*e*_2, 10*e*_3 and 10*e*_4 may comprise the spring element which is movable transverse to the third degree of freedom Z, wherein the means for latching the second engagement portion 12*e*_1 and 12*e*_2 comprise a recess transverse to the third degree of freedom Z which the spring element may engage in.

Figure 2A:
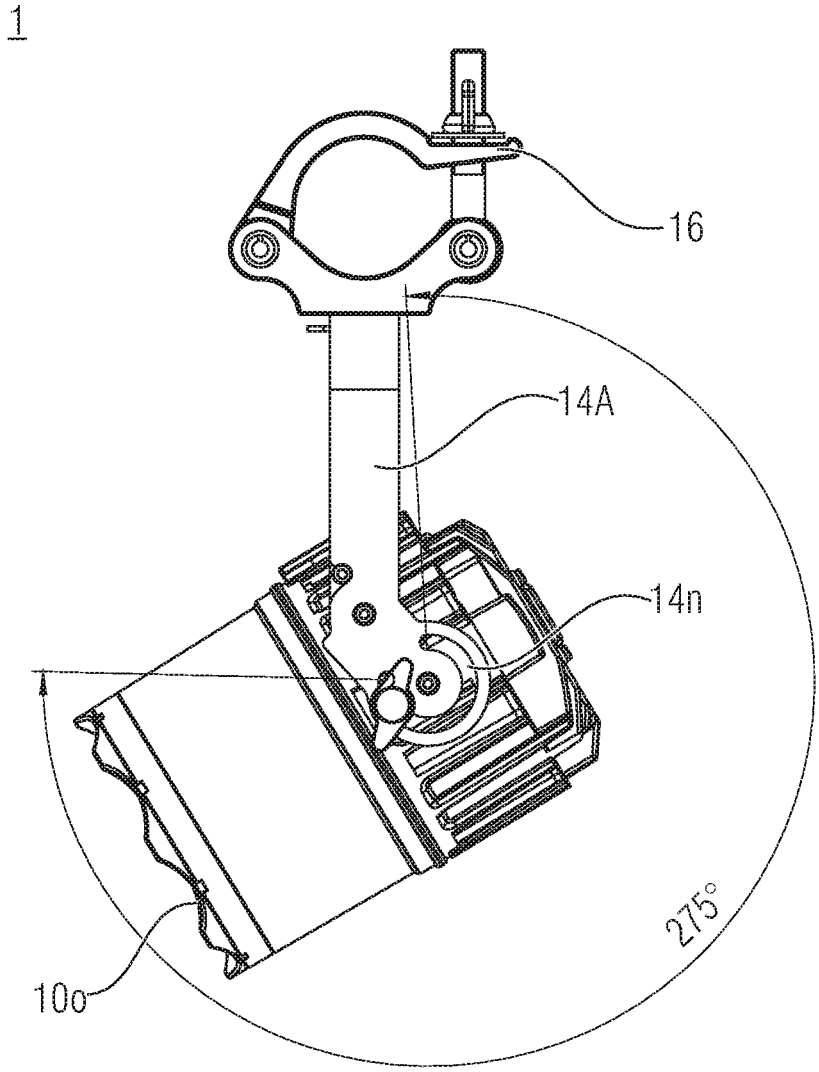
FIG. 2A, FIG. 2B, and FIG. 2C shows four schematic lateral views of a housing of a lighting apparatus in combination with two connectors and a bracket and a clamp for mounting the lighting apparatus to a cross-beam in accordance with embodiments.
Figure 2B:
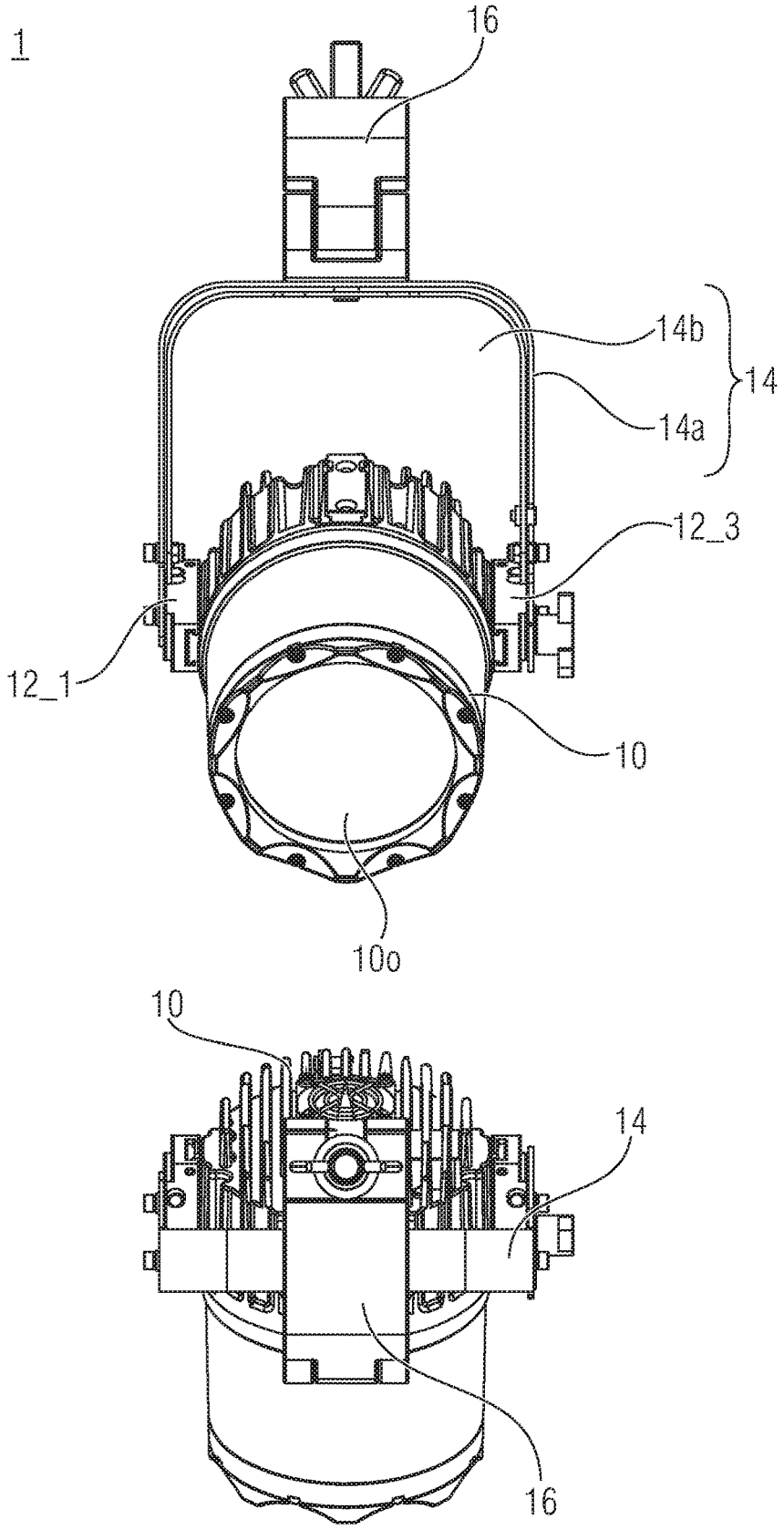
Figure 2C:
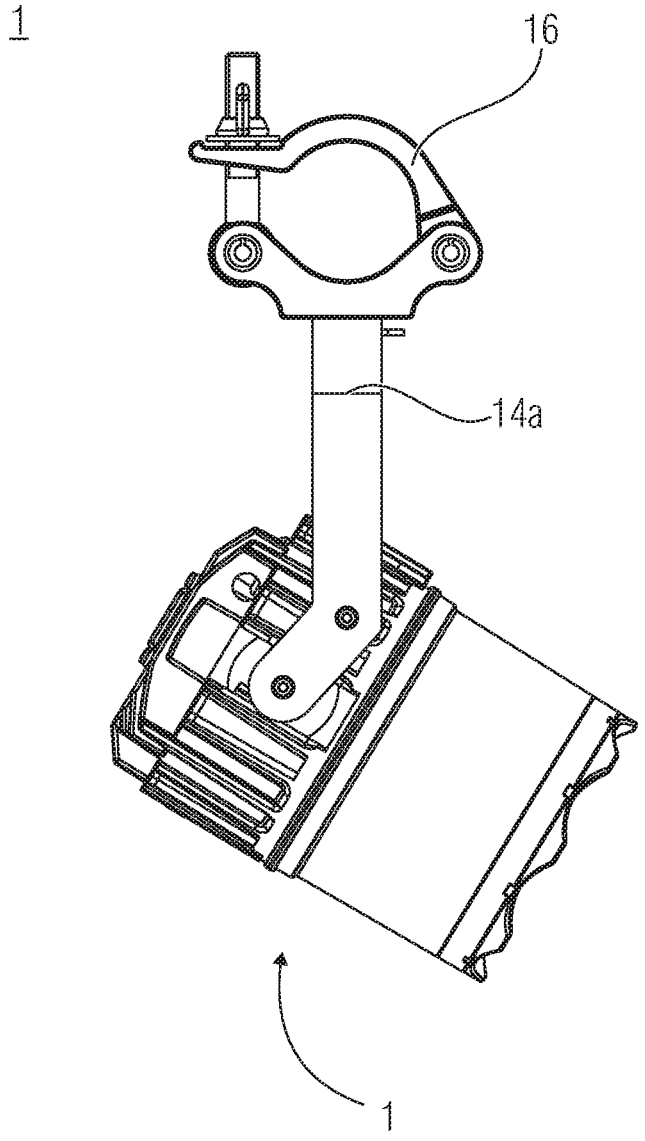

FIG. 2A, FIG. 2B, and FIG. 2C shows the housing 10 of the lighting apparatus 1 in combination with the two connectors 12_1 and 12_3 which are coupled to the bracket 14. In the lateral view, it is also illustrated that the bracket 14, more precisely the bracket 14*a* with the slot 14*n*, allows a range of movement of 275°. The individual brackets 14*a* and 14*b* of the double bracket 14 here are pushed together (second position) and together connected to a clamp 16 by means of which the unit may be coupled to a further element, for example a cross-beam. Thus, it is also possible to position the lighting apparatus 1 with the housing 10 not only in a self-supported, but also in a suspended manner.

In correspondence with further embodiments, it would be possible for the housing to be coupled to further housings via so-called interconnectors. This is discussed making reference to FIG. 3*a*-1, FIG. 3*a*-2, FIG. 3*b*-1, and FIG. 3*b*-2.

FIG. 3*a*-1 and FIG. 3*a*-2 shows a housing 10 with its engagement portion 10*e*_1 to 10*e*_4 in combination with a further connector, that is the connector 22 which comprises two second engagement portions 22*a* and 22*b* and is thus suitable for connecting two housings to each other. Connecting the connector 22 with the engagement portion 10*e*_1 is illustrated in FIG. 3*a*-1 and FIG. 3*a*-2, whereas connecting the connector 22 to the engagement portion 10*e*_2 is illustrated in FIG. 3*b*-1 and FIG. 3*b*-2. In addition, an enlargement illustration (cf. A and B) is illustrated for each view 3*a* and 3*b*, in addition to the four successive views of the push-in process.

As can be seen from FIGS. 3*a* and 3*b*, the process of pushing in is done by the connector 22 being moved in a longitudinal direction (cf. arrow 10*l*) along the profile-shaped engagement portion 10*e*_1 and 10*e*_2, until the second engagement portion 22*b* of the connector 22 is completely engaged with the first engagement portion 10*e*_1 and 10*e*_2 of the housing 10. This state is illustrated in the respective last views of FIGS. 3*a* and 3*b*.

In correspondence with embodiments, latching means may be provided in the connector 22, which here is provided with the reference numeral 22*r*. The latching device 22*r* engages in the slot 10*r* of the engagement portions 10*e*_1 and 10*e*_2. With no latch device provided, such a connection between the engagement portions 22*b* and 10*e*_1 and 10*e*_2, respectively, would restrict only the three rotary degrees of freedom and two lateral degrees of freedom. The latch device now allows restricting the third lateral degree of freedom and may be released manually from outside, for example. This variation allows improving the operability of the quick connector.

In correspondence with further embodiments, the engagement portion 10*e*_1 and 10*e*_2 may have a tapered front end so that inserting the engagement portion 22*b* of the connector 22 is made easier.

As is illustrated here, in correspondence with embodiments, the connector 22 may be realized as a screw structure. In accordance with embodiments, the engagement portion 10*e*_1 and 10*e*_2 may be formed as a so-called slot nut which is screwed to the housing 10 by means of screws 10*s* such that the slot nut 10*e*_1 and 10*e*_2 extends along the longitudinal direction 10*l*.

Systems where the connectors 22 are used will be discussed below referring to FIGS. 4*a* and 4*b*.

Figures 1, 4A:
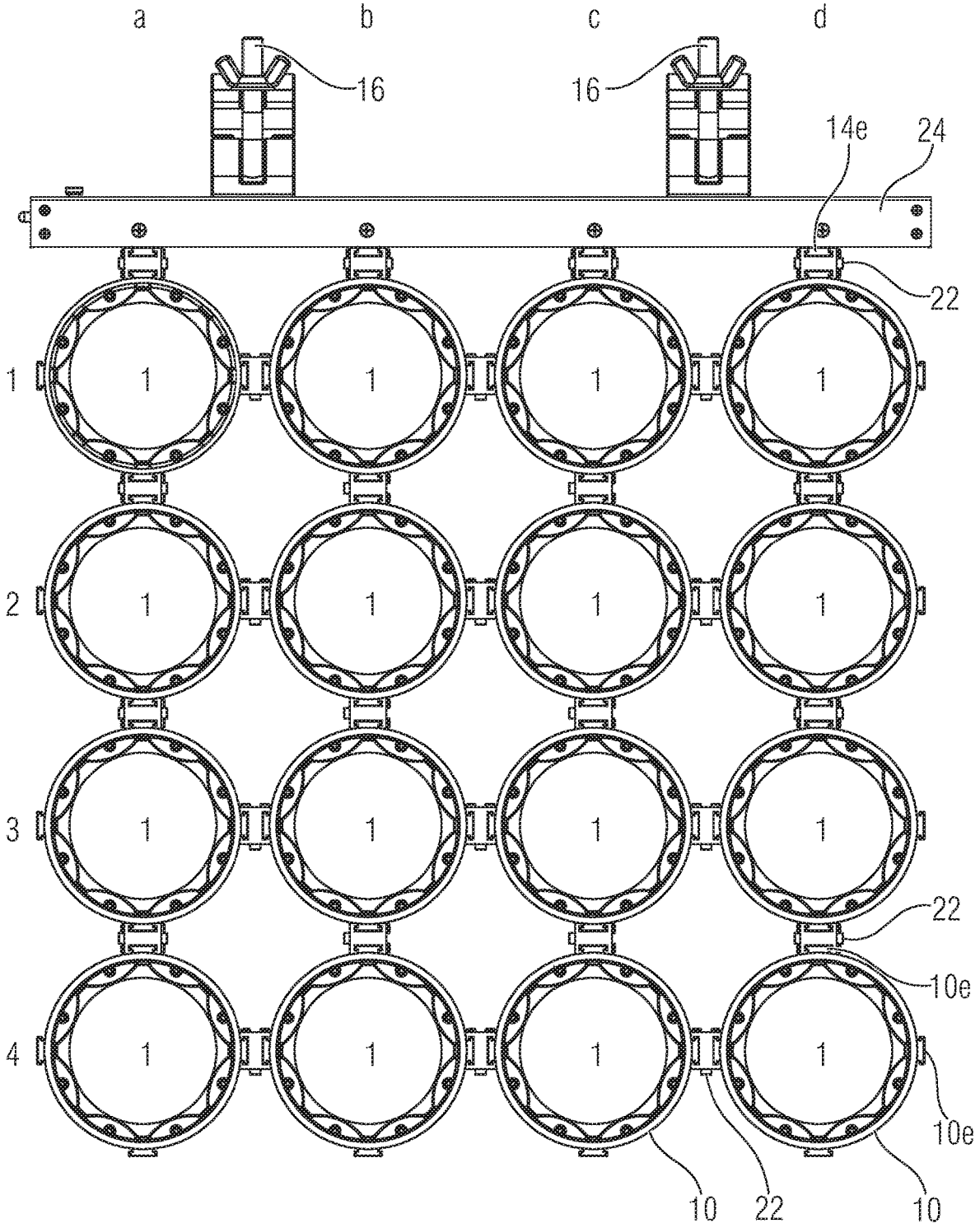
Figures 2, 4A:
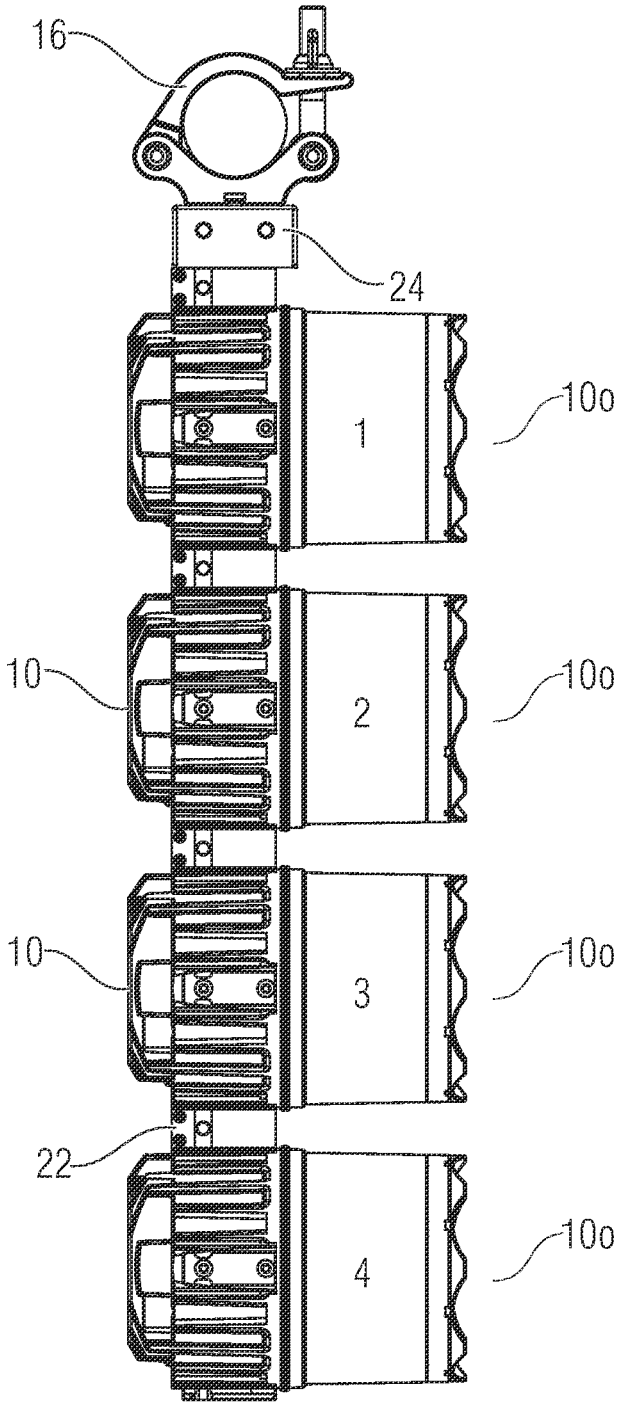

FIG. 4*a*-1 and FIG. 4*a*-2 shows a lighting matrix comprising 4×4 four lighting units with the lighting housing 10. For improved reference, the columns are numbered a to d and the rows are numbered 1 to 4. Every column and every row is complete, that is occupied by four housings, wherein each housing located in a corner, that is, for example, 1*a*, 1*d*, 4*a* and 4*d*, is connected to a neighboring housing 10 on a first side and to a further housing on a side offset by 90°. The connection is done, as indicated, using the connectors 22 and the respective engagement portions 10*e* of the housings. The housings 10 not arranged at the corners, that is, for example, the housings of the second and third rows and columns b and c, are connected to at least three further housings 10 or even, when considering positions 2*b*, 2*c*, 3*b* and 3*c*, to four further housings, that is connected at three, six, nine and 12 o'clock. The connectors 22 are used in all the connections within the matrix.

In accordance with embodiments, the housings in the top row, that is the housings of row 1, may all be coupled to a so-called parallel connector 24. The parallel connector 24 comprises four engagement portions 24*e* arranged next to one another or in parallel to one another, which are comparable to the engagement portions 10*e*. Thus, it is also possible to connect the parallel connector 24 to the lighting matrix or the four lighting apparatus housings 10 of row 1 by means of connective elements 22.

The engagement portions 24*e* are spaced apart from one another such that they are able to couple the housings 10 next to one another. This means that the distance is fixed in correspondence with the diameter of a housing 10 so that the housings arranged next to one another may also be connected to one another directly via a connector 22. In this embodiment, the clamp 16 is provided or even two clamps 16 are provided on a side opposite of the engagement portions 24*e* so that the entire lighting matrix may be suspended. Alternatively, it would also be conceivable to provide respective feet so as to put the lighting matrix in place.

Irrespective of the type of mounting of the lighting matrix, the lighting matrix offers advantages in that all the 4×4 lighting apparatuses are aligned to be oriented equally next to one another by means of the sliding connectors (cf. lateral view from which the orientation of the opening 10*o* becomes obvious) and thus illuminate an area.

When, for example, the area is not illuminated at full intensity, one option would be not inserting certain lighting apparatuses into the matrix. Such an example is illustrated in FIG. 4*b*-1 and FIG. 4*b*-2.

Figures 1, 4B:
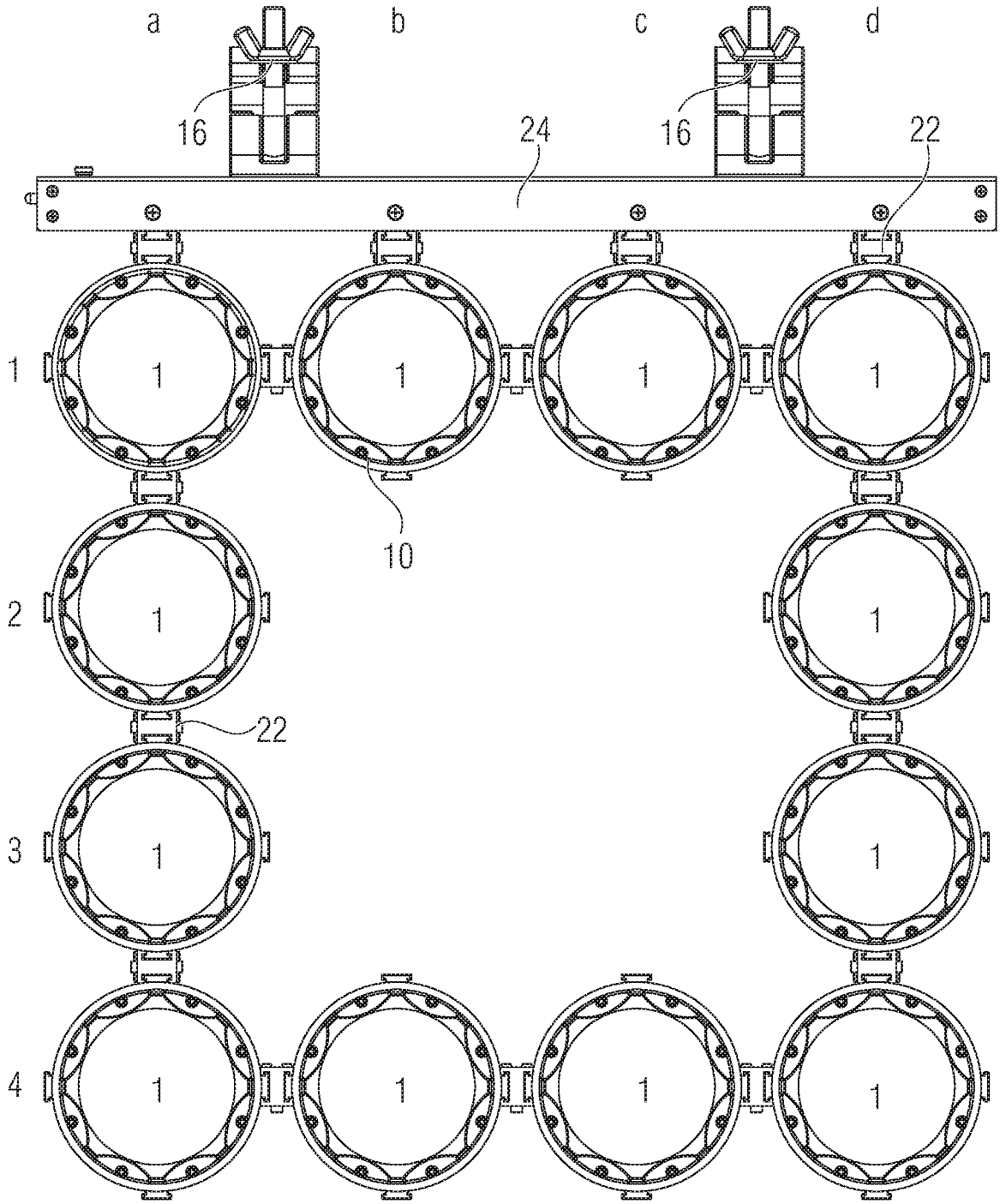
Figures 2, 4B:
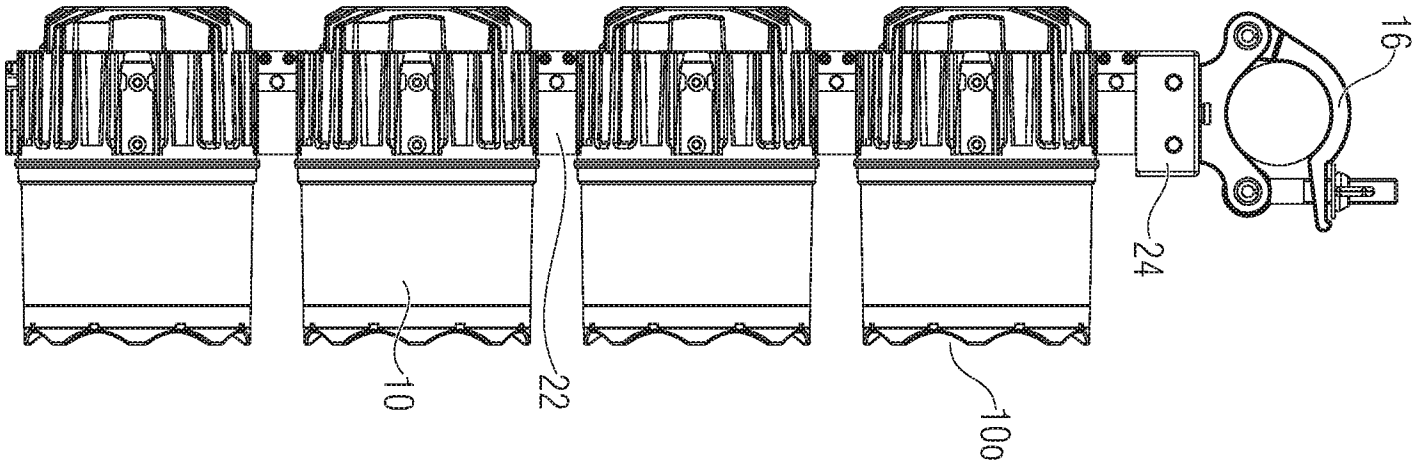

FIG. 4*b*-1 and FIG. 4*b*-2 shows a lighting matrix where the housings of the lighting apparatuses are not occupied by lighting apparatuses at the positions 2*b*, 2*c*, 3*b* and 3*c*. Consequently, the result is a rectangular lighting matrix where only the edge regions are occupied. In contrast to the matrix of FIG. 4*a*-1 and FIG. 4*a*-2, that situation where each lighting apparatus is connected to lighting apparatuses by two or more connectors 22 will not occur, but only by a maximum of two connectors 22 when not considering coupling of the lighting matrix to a further element, like a clamp 16 also illustrated here. Expressed differently, this means that the only elements engaged with more than two connectors 44 are the four lighting apparatuses of the first row which are coupled to the parallel connector 24 via the connectors 22. As also becomes obvious in the lateral view, all the lighting apparatuses of the matrix are oriented equally (cf. reference numeral 10*o*) and aligned in parallel.

Subsequently, three different variations of connections between lighting apparatuses will be discussed referring to FIGS. 5*a* to 5*c*, wherein it is to be mentioned that further connections which can be pushed into one another are also possible.

Figure 5A:
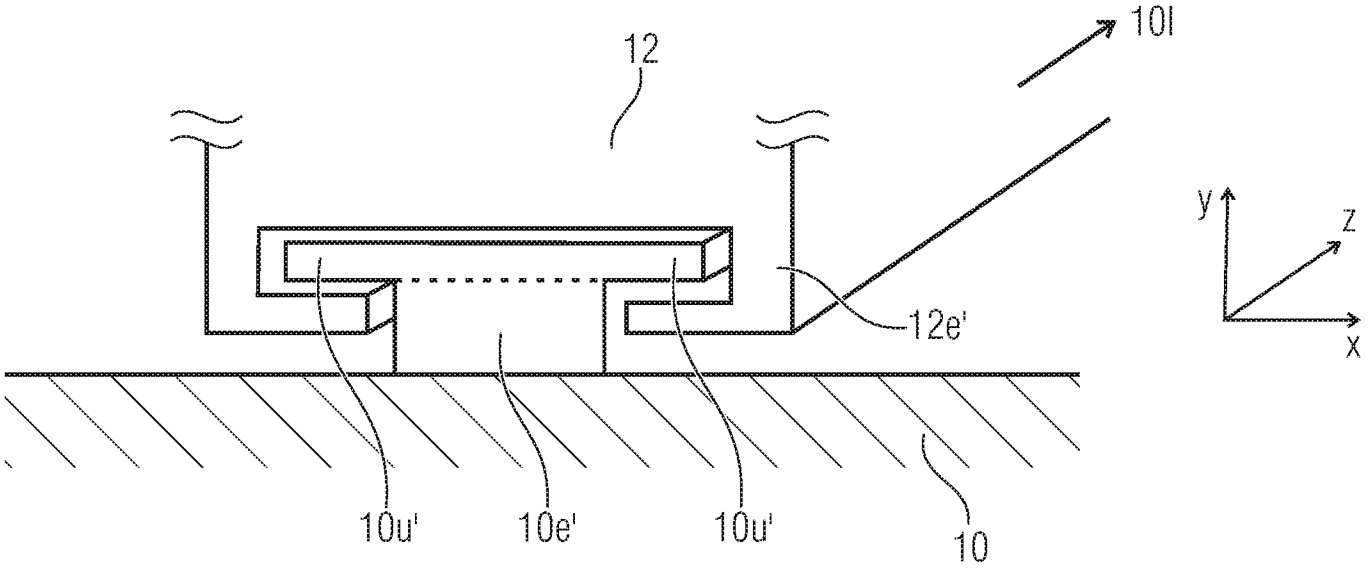
FIG. 5*a*, FIG. 5*b*, and FIG. 5*c* show connections comprising first and second engagement portions with and without undercutting in accordance with embodiments.

FIG. 5*a* shows a first connection between an engagement portion 10*e*' of the housing 10 and an engagement portion 12*e*' of the connector 12. The engagement portion 10*e*' is, for example, screwed to the housing 10 as an external element and comprises a lower narrower region and an upper broader region thereby forming a mushroom shape. These two regions may, for example, be realized by two plates of different widths or also an extrusion profile. The result is that a projection 10*u*' is provided on one side and a projection 10*u*' is provided on the other side in a distance to the surface of the housing 10 so that the engagement portion 10*e*' may engage in this gap provided by the distance. The engagement portion 12*e*' of the connector 12 basically forms a C shape which comprises an undercutting and is configured to engage in the gap provided by the engagement portion 10*e*'. The two connectors are fitted into each other by laterally shifting along the direction 10*l* or z and, after fitting, may absorb lateral forces in both the x and y direction, but also all three rotational forces around all three rotary degrees of freedom.

Further variations of the mushroom shape, for example with a round top side, that is precisely mushroom-shaped, would also be conceivable. Such a variation is shown in FIG. 5*b*, for example.

Figure 5B:
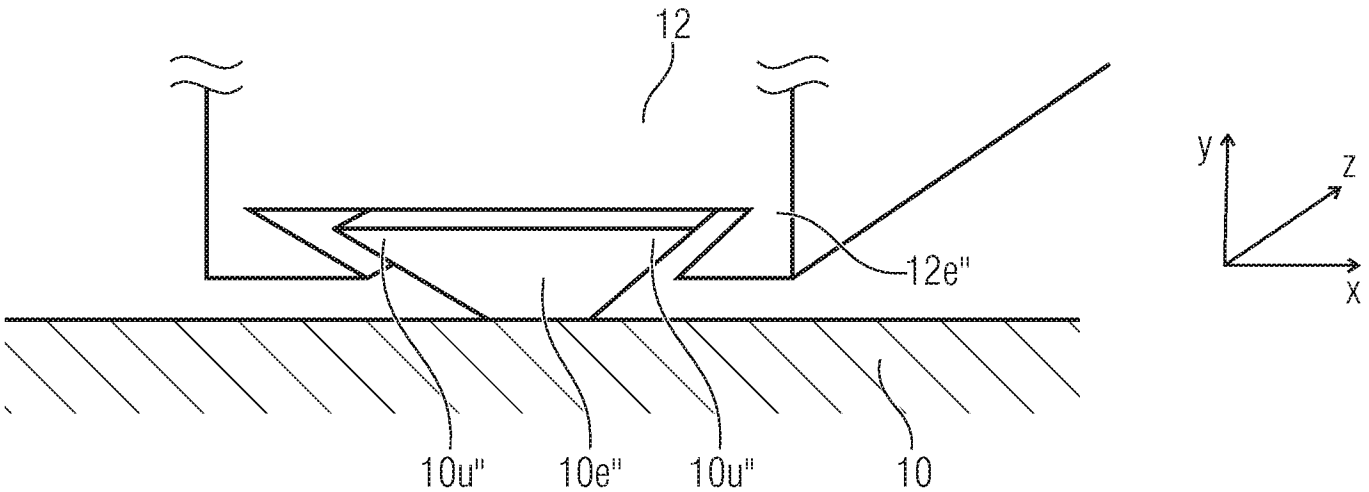

FIG. 5*b* shows a dovetail which is termed engagement portion 10*e*", instead of the mushroom. The engagement portion 10*e*" also comprises two projections 10*u*" below which the engagement portion 12*e*" of the connector 12 can engage. This dovetail may also be screwed onto the housing 10 and, in the result, allows the same force to be absorbed like in the connection illustrated in FIG. 5*a*.

Figure 5C:
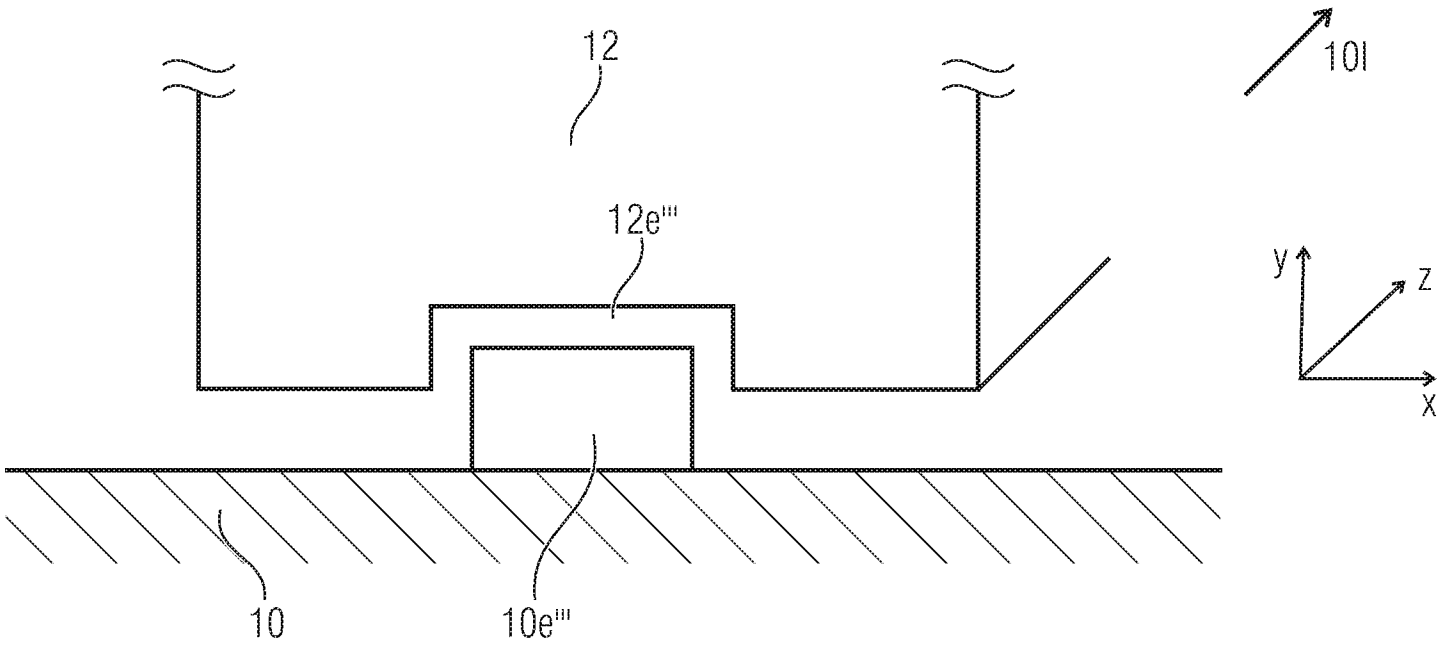

FIG. 5*c* shows a further connector, that is a simple tongue and slot connection. Here, only a simple slot nut 10*e*'" which forms the engagement portion, is applied on the housing 10, wherein the slot nut 10*e*'", in contrast to the slot nut in FIGS. 5*a* and 5*b*, does not comprise an undercutting. An engagement portion 12*e*'" engages in said slot nut.

This connector shares with the two previous connectors the fact that it may be fitted by pushing in the z direction (cf. longitudinal axis 10*l*). In contrast to the two previous connectors, however, it is not configured to absorb longitudinal forces along the y axis, in particular in the direction of travel. Due to the fact that the connector may be employed with a retainer (cf. FIGS. 1*a* and 1*b*) which is implemented as a bracket or double bracket, the connector does not have to absorb such tensile forces so that the connector is nevertheless configured to support not only the three rotation moments, but also the two longitudinal forces.

In accordance with further embodiments, the connector may also be equipped differently so that the housing 10 comprises the slot, whereas the slot nut is applied on or integrated in the connector 12, for example.

Even though it has not been mentioned explicitly, it is obvious that the lighting apparatus, apart from the housing, also comprises a lighting unit, like an incandescent light or LED including a respective supply line, for example.

The embodiments described above merely represent an illustration of principles of the present invention. It is to be understood that modifications and variations of the arrangements and details described herein will be obvious to others skilled in the art. Therefore, the invention is intended to be limited solely by the scope of the following claims, but not the specific details having been presented herein making reference to the description and discussion of the embodiments.

The invention claimed is:

1. A system comprising:

a housing of a lighting apparatus; and a connector for connecting the housing of the lighting apparatus;

the housing comprising:

at least two first engagement portions at two different sides of the housing;

wherein each first engagement portion is suitable for being connectable to a second engagement portion of a connector by translatory pushing into each other such that the housing is restricted relative to the connector in two degrees of freedom in a translatory respect and in three degrees of freedom in a rotary respect;

wherein the at least two first engagement portions are each formed by a plate spaced apart from the housing or a slot;

wherein the first engagement portion comprises means for latching suitable for allowing engagement of the means for latching of the second engagement portion in the first engagement portion so that the housing is restricted relative to the connector in a third degree of freedom in a translatory respect;

wherein the means for latching of the first engagement portion comprise a spring element which is movable transverse to the third degree of freedom; and wherein the means for latching of the second engagement portion comprise a recess transverse to the third degree of freedom, in which the spring element may engage; or wherein the means for latching of the second engagement portion comprise a spring element which is movable transverse to the third degree of freedom; and wherein the means for latching of the first engagement portion comprise a recess transverse to the third degree of freedom, in which the spring element may engage;

the connector comprising:

at least one second engagement portion for the housing; and a further engagement portion for an element coupled to the housing;

wherein every second engagement portion is connectable to the first engagement portion of the housing by translatory pushing into each other such that the housing is restricted relative to the connector in two degrees of freedom in a translatory respect and in three degrees of freedom in a rotary respect;

wherein the first engagement portion comprises means for latching suitable for allowing engagement of the means for latching of the second engagement portion in the first engagement portion so that the housing is restricted relative to the connector in a third degree of freedom in a translatory respect;

wherein the means for latching of the first engagement portion comprise a spring element which is movable transverse to the third degree of freedom; and wherein the means for latching of the second engagement portion comprise a recess transverse to the third degree of freedom, in which the spring element may engage; or wherein the means for latching of the second engagement portion comprise a spring element which is movable transverse to the third degree of freedom; and wherein the means for latching of the first engagement portion comprise a recess transverse to the third degree of freedom, in which the spring element may engage;

wherein the means for latching may be released from outside.

2. The system in accordance with claim 1, wherein the first engagement portions, together with the second engagement portion, form a tongue and slot connection, an undercutting connection and/or a dovetail connection.

3. The system in accordance with claim 1, wherein the first engagement portions each comprise a first rail extending along a longitudinal axis, which comprises a first profile extending along the longitudinal axis, wherein the second engagement portions each comprise a second rail extending along the longitudinal axis, which comprises a second profile extending along the longitudinal axis, wherein either the first or the second profile forms an undercutting into which the other profile may be pushed along the longitudinal axis.

4. The system in accordance with claim 1, wherein the two first engagement portions are provided on opposite sides of the housing.

5. The system in accordance with claim 1, wherein the housing comprises at least three sides and totally at least three or four first engagement portions are provided on three or four sides of the housing.

6. The system in accordance with claim 1, wherein the at least two first engagement portions are screwed to the housing.

7. The system in accordance with claim 1, wherein the first engagement portions extend over at most a first half of the length of the housing; and/or wherein the first engagement portions are arranged on a back part of the housing.

8. The system in accordance with claim 1, wherein the housing comprises a lighting opening on a front part of the housing; and/or wherein the lighting opening on the front part has a round shape.

9. The system in accordance with claim 1, wherein the element coupled to the housing is a one-sided clamp, and wherein the further engagement portion is implemented as a retainer for the housing for connecting to the one-sided clamp.

10. The system in accordance with claim 1, wherein the element coupled to the housing is a two-sided bracket, and wherein the further engagement portion is implemented as a retainer for the housing for connecting to the two-sided bracket, wherein the two-sided bracket is connected to an additional further engagement portion of an additional connector which engages in the other first engagement portion on the opposite side of the housing.

11. The system in accordance with claim 1, wherein the two-sided bracket is implemented as a double bracket having two individual brackets which may be positioned to each other in a first relative position where the individual brackets are arranged to be angled, and in a second relative position where the individual brackets are arranged to be parallel to each other, wherein the double bracket in the first relative position forms a foot and forms a suspending retainer in the second relative position.

12. The system in accordance with claim 5, wherein a rectangular angle is provided between at least two of the totally three first engagement portions or between the four of the totally four first engagement portions.

13. A system comprising:

a housing of a lighting apparatus; and two connectors for connecting the housing of the lighting apparatus;

the housing comprising:

at least two first engagement portions at two different sides of the housing;

wherein each first engagement portion is suitable for being connectable to a second engagement portion of a connector by translatory pushing into each other such that the housing is restricted relative to the connector in two degrees of freedom in a translatory respect and in three degrees of freedom in a rotary respect;

wherein the at least two first engagement portions are each formed by a plate spaced apart from the housing or a slot;

wherein the first engagement portion comprises means for latching suitable for allowing engagement of the means for latching of the second engagement portion in the first engagement portion so that the housing is restricted relative to the connector in a third degree of freedom in a translatory respect;

wherein the means for latching of the first engagement portion comprise a spring element which is movable transverse to the third degree of freedom; and wherein the means for latching of the second engagement portion comprise a recess transverse to the third degree of freedom, in which the spring element may engage; or wherein the means for latching of the second engagement portion comprise a spring element which is movable transverse to the third degree of freedom; and wherein the means for latching of the first engagement portion comprise a recess transverse to the third degree of freedom, in which the spring element may engage;

each connector comprising:

at least one second engagement portion for the housing; and a further engagement portion for an element coupled to the housing;

wherein every second engagement portion is connectable to the first engagement portion of the housing by translatory pushing into each other such that the housing is restricted relative to the connector in two degrees of freedom in a translatory respect and in three degrees of freedom in a rotary respect;

wherein the first engagement portion comprises means for latching suitable for allowing engagement of the means for latching of the second engagement portion in the first engagement portion so that the housing is restricted relative to the connector in a third degree of freedom in a translatory respect;

wherein the means for latching of the first engagement portion comprise a spring element which is movable transverse to the third degree of freedom; and wherein the means for latching of the second engagement portion comprise a recess transverse to the third degree of freedom, in which the spring element may engage; or wherein the means for latching of the second engagement portion comprise a spring element which is movable transverse to the third degree of freedom; and wherein the means for latching of the first engagement portion comprise a recess transverse to the third degree of freedom, in which the spring element may engage;

wherein the element coupled to the housing is a two-sided bracket, and wherein the further engagement portion is implemented as a retainer for the housing for connecting to a two-sided bracket, wherein the two-sided bracket is connected to an additional further engagement portion of an additional connector which engages in the other first engagement portion on the opposite side of the housing; and a two-sided bracket;

wherein the means for latching may be released from outside.

* * * * *